US007677253B2

(12) United States Patent
Yamada et al.

(10) Patent No.: US 7,677,253 B2
(45) Date of Patent: Mar. 16, 2010

(54) METHOD OF MANUFACTURING REGENERATED TOBACCO MATERIAL

(75) Inventors: Yoshiyuki Yamada, Yokohama (JP); Yukiko Hasegawa, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 1140 days.

(21) Appl. No.: 11/265,305

(22) Filed: Nov. 3, 2005

(65) Prior Publication Data

US 2006/0065279 A1 Mar. 30, 2006

Related U.S. Application Data

(63) Continuation of application No. PCT/JP2004/006001, filed on Apr. 26, 2004.

(30) Foreign Application Priority Data

May 6, 2003 (JP) ..... 2003-128104
Nov. 13, 2003 (JP) ..... 2003-384083

(51) Int. Cl.
*A01J 13/00* (2006.01)

(52) U.S. Cl. ..... 131/297; 131/298

(58) Field of Classification Search ..... 131/297, 131/298, 309, 300, 356
See application file for complete search history.

(56) References Cited

U.S. PATENT DOCUMENTS 4,253,929 A 3/1981 Keritsis
4,301,817 A 11/1981 Keritsis
4,364,401 A 12/1982 Keritsis
4,589,428 A * 5/1986 Keritsis ..... 131/297
4,941,484 A * 7/1990 Clapp et al. ..... 131/297
4,962,774 A * 10/1990 Thomasson et al. ..... 131/309
2002/0134394 A1 9/2002 Baskevitch et al.

FOREIGN PATENT DOCUMENTS

| | | | |
|---|---|---|---|
| CN | 1087076 | A | 5/1994 |
| CN | 1329855 | A | 1/2002 |
| JP | 56-148275 | A | 11/1981 |
| JP | 62-289167 | A | 12/1987 |
| JP | 5-292935 | A | 11/1993 |
| RU | 2198575 | C1 | 2/2003 |
| TW | 131771 | | 4/1990 |
| TW | 167411 | | 9/1991 |
| WO | WO 01/65954 | A1 | 9/2001 |

* cited by examiner

*Primary Examiner*—Carlos Lopez
(74) *Attorney, Agent, or Firm*—Birch, Stewart, Kolasch & Birch, LLP

(57) ABSTRACT

A regenerated tobacco material is manufactured through extracting a natural tobacco material with an extracting solvent to obtain an extracted solution containing components of the natural tobacco material and an extraction residue. A regenerated tobacco web is prepared by using the extraction residue. On the other hand, the extracted solution is subjected to a fractionating treatment by means of ultrafiltration, reverse osmosis filtration, or reversed-phase partition chromatography to obtain a first fraction enriched in desired components and depleted in undesired components, and a second fraction enriched in the undesired components and depleted in the desired components. The first fraction is added, optionally together with the second fraction decreased in amount, to the regenerated tobacco web to prepare a regenerated tobacco material.

8 Claims, 2 Drawing Sheets

METHOD OF MANUFACTURING REGENERATED TOBACCO MATERIAL

CROSS-REFERENCE TO RELATED APPLICATIONS

This is a Continuation Application of PCT Application No. PCT/JP2004/006001, filed Apr. 26, 2004, which was published under PCT Article 21(2) in Japanese.

This application is based upon and claims the benefit of priority from prior Japanese Patent Applications No. 2003-128104, filed May 6, 2003; and No. 2003-384083, filed Nov. 13, 2003, the entire contents of both of which are incorporated herein by reference.

BACKGROUND OF THE INVENTION

1. Field of the Invention

The present invention relates to a method of manufacturing a regenerated tobacco material.

2. Description of the Related Art

Various components such as nicotine, nitrates, nitrosamines, hydrocarbons and proteins are contained in tobacco materials such as the leaf, shreds, central vein, stalk, and root of natural tobacco plants. These components are extracted from natural tobacco materials and are used as a flavoring additive to tobacco. These components include those which are desirable to be decreased in amount or to be removed, on one hand, and also include those which are desirable not to be removed or to be increased in amount, in view of the tobacco flavor or some other reasons.

For example, U.S. Pat. No. 4,253,929 and U.S. Pat. No. 4,364,401 disclose a method in which tobacco materials are extracted with an aqueous extracting solvent, followed by subjecting the extracted aqueous solution to an electrodialysis to separate and remove the nitrate ions. Various tobacco articles can be manufactured by adding the extracted solution, having the nitrate ions removed therefrom, to the extraction residue forming fibrous tobacco materials.

U.S. Patent Publication US 2002/0134394 A1 (corresponding to International Publication WO 02/28209 discloses a method in which an extracted solution obtained by extracting tobacco materials with an extracting solvent is treated with a sorption agent capable of adsorbing/absorbing nitrosamines, such as activated carbon, to remove nitrosamines from the extracted solution. Various tobacco articles can be manufactured by adding the extracted solution, having nitrosamine removed therefrom, to the extraction residue forming the fibrous tobacco materials.

International Publication WO 01/65954 discloses extracting nitrosamines by treating tobacco with a supercritical carbon dioxide, and subjecting the extract to a nitrosamine removing process. The nitrosamine removing process includes a separating operation by chromatography. However, this chromatography is not disclosed in detail, and the material to be subjected to the chromatography is not an aqueous extracted material.

In the separating/removing method utilizing the electrodialysis noted above, the object that is to be removed is limited to ions and, thus, the method cannot be used widely. Also, the extracted solution tends to be denatured by the voltage application during the electrodialysis. The extracted solution also tends to be denatured by heating that is applied for improving the separation efficiency. Further, where useful components contained in the dialyzate, having the nitrate ions removed therefrom, is to be used for a certain purpose, it is necessary to apply a concentrating treatment to the dialyzate. A similar concentrating treatment may be required in the separating method using a sorption agent. Also, the method using the supercritical carbon dioxide necessitates a costly apparatus.

Therefore, an object of the present invention is to provide a method of manufacturing a regenerated tobacco material, in which a fraction rich in a desired component and poor in an undesired component and another fraction poor in the desired component and rich in the undesired component are obtained from an extracted solution extracted from natural tobacco materials, and one or both of these fractions are used to manufacture the regenerated tobacco materials.

BRIEF SUMMARY OF THE INVENTION

According to the present invention, there is provided a method of manufacturing a regenerated tobacco material, comprising the steps of (a) extracting a natural tobacco material with an extracting solvent to obtain an extracted solution containing components of the natural tobacco material and an extraction residue, the natural tobacco materials containing both desired components and undesired components, (b) fractionating the extracted solution by means of ultrafiltration, reverse osmosis filtration, or reversed-phase partition chromatography to obtain a first fraction enriched in the desired components and depleted in the undesired components and a second fraction enriched in the undesired components and depleted in the desired components, (c) preparing a regenerated tobacco web by using the extraction residue, and (d) adding the first fraction to the regenerated tobacco web optionally together with the second fraction decreased in amount.

DETAILED DESCRIPTION OF THE INVENTION

The present invention will now be described in more detail.

The present invention relates to a method of manufacturing a regenerated tobacco material by using an extracted solution and an extraction residue obtained by subjecting a natural tobacco material to extraction. A regenerated tobacco web is prepared by using the extraction residue.

The extracted solution is subjected to a fractionating operation by means of ultrafiltration, reverse osmosis filtration, or reversed-phase partition chromatography. The extracted solution obtained from the natural tobacco material contains those which are desirable to be decreased in amount or to be removed (undesired components), on one hand, and also include those which are desirable not to be removed or to be increased in amount (desired components), in view of the tobacco flavor or some other reasons. By the fractionating operation according to the present invention, there are obtained a first fraction, which is enriched in the desired components and depleted in the undesired components, and a second fraction, which is enriched in the undesired components and depleted in the desired components. A desired regenerated tobacco material is manufactured by adding the first fraction to the regenerated tobacco web optionally together with the second fraction decreased in amount.

Figure 1:
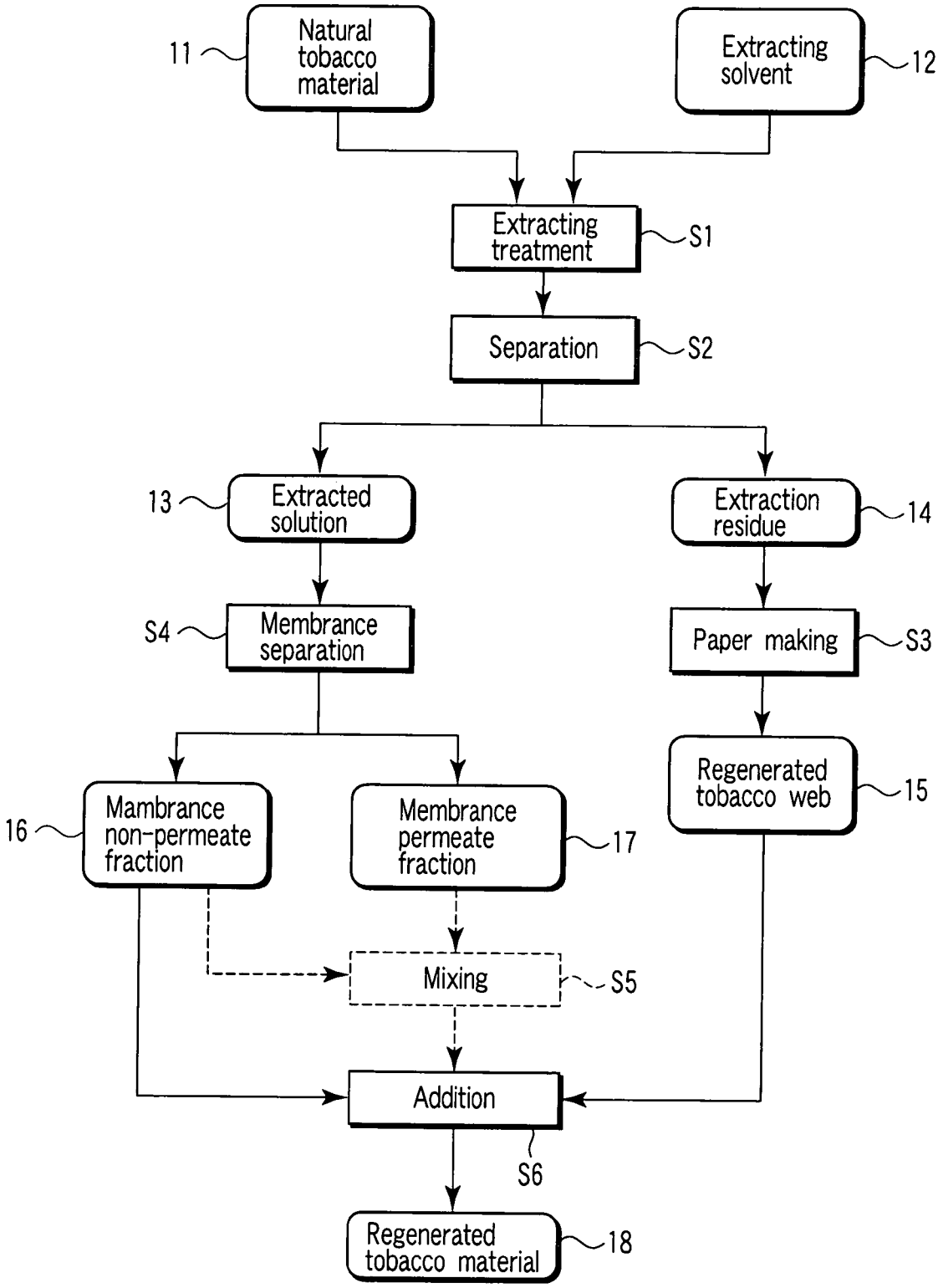
FIG. 1 is a flowchart for explaining a method of manufacturing a regenerated tobacco material according to one embodiment of the present invention.

FIG. 1 is a flowchart for explaining a method of manufacturing a regenerated tobacco material according to one embodiment of the present invention. In this embodiment, the fractionating operation to the extracted solution is carried out by means of the ultrafiltration or reverse osmosis filtration.

As shown in FIG. 1, a natural tobacco material 11 is mixed with an extracting solvent 12, and the mixture is stirred so as to subject the natural tobacco material 11 to an extracting treatment S1.

As the natural tobacco material 11, use may be made of the leaf, the shredded leaves, central vein, the stalk, and the root of the tobacco plant as well as a mixture thereof. Water or an organic solvent, for example, may be used as the extracting solvent. The extracting solvent such as water may be alkaline or acidic. As the extracting solvent, a mixture of water and an organic solvent that is miscible with water may also be used. Examples of the organic solvent include, for example, alcohols such as ethanol, ethers such as diethyl ether, and hydrocarbon solvents such as cyclohexane. An inorganic salt such as sodium hydroxide may be dissolved in the extracting solvent. In general, the extracting treatment is carried out at a temperature of 0 to 100° C. for 5 minutes to 6 hours.

After completion of the extracting treatment S1, the extracted mixture obtained is subjected to a separating treatment S2 by, for example, filtration to separate the extracted mixture into an extracted solution 13 and an extraction residue 14.

The natural tobacco material contains salts of metals such as potassium salt, nitrates, nicotine, sugars, amino acids, glycoside, amino-sugar compounds, proteins, hydrocarbons (saturated hydrocarbons, unsaturated hydrocarbons, aromatic hydrocarbons), alcohols, ethers, aldehydes, ketones, esters, lactones, quinones, acids (including acid anhydrides), phenols, amines, pyrroles, pyridines, pyrazines, alkaloids, polycyclic nitrogen-containing compounds, nitroso compounds such as nitrosamines (including tobacco-specific nitrosamines (TSNAs), amides, lipids, halides, sulfur-containing compounds, and inorganic elements. The extracted solution 13 obtained by the extracting treatment noted above can contain substantially all of the components mentioned above, though depending on the extracting solvent used. Of these components, which components are the desired components and which components are the undesired components vary depending on, for example, the desired taste or flavor of the regenerated tobacco material that is to be manufactured. However, at least nicotine is the desired component, and nitrates and amines including nitrosamines such as TSNAs are the undesired components.

The extraction residue 14 is a component insoluble in the extracting solvent and consists essentially of fibers. A regenerated tobacco web is manufactured by an ordinary method by using the extraction residue 14. The extraction residue may constitute the entire regenerated tobacco web or a part of the regenerated tobacco web. For example, a regenerated tobacco web 15 can be obtained by subjecting pulp material containing the extraction residue 14 to an ordinary paper-making process S3.

On the other hand, the extracted solution obtained by the separating treatment S2 is subjected to a membrane separation treatment S4. The membrane separating treatment S4 is performed by ultrafiltration or reverse osmosis filtration. The membranes used for the membrane separating treatment (i.e., the ultrafiltration membrane and the reverse osmosis filtration membrane) are porous membranes provided with pores having a prescribed size or less, and separate and fractionate solutes based mainly on the difference in size between the pore of the membrane and the solute molecules. The molecular weight of the smallest solute that is incapable of passing through the membrane is called the cut-off molecular weight of the membrane. In general, the cut-off molecular weight of the ultrafiltration membrane is 1,000 to 1,000,000, and the cut-off molecular weight of the reverse osmosis filtration membrane is 100 to 1,000. These membranes are commercially available. For example, as the ultrafiltration membrane, use may be made of Biomax 5 (a cut-off molecular weight of 5,000) and PCXK cellulose (a cut-off molecular weight of 1,000,000), available from Milipore Inc. As the reverse osmosis filtration membrane, use may be made of Nanomax 95 (a cut-off molecular weight of about 100) and Nanomax 50 (a cut-off molecular weight of about 400), available from Milipore Inc. The membrane separation by the ultrafiltration and the reverse osmosis filtration can be performed by the procedures known pre se in the art. In performing the membrane separation, the extracted solution 13 may be at a low temperature of 0° C. to 30° C., with the result that the components contained in the extracted solution are unlikely to be denatured. Incidentally, the reverse osmosis filtration membrane (reverse osmosis membrane) is capable of efficiently separating hydrated ions such as nitrate ions.

By the membrane separating treatment S4, those natural tobacco components which have a molecular weight larger than the cut-off molecular weight of the membrane used are obtained as the membrane non-permeate fraction 16 and those tobacco components which have a molecular weight smaller than the cut-off molecular weight of the membrane used are obtained as a membrane permeate fraction 17. In other words, the membrane non-permeate fraction 16 is enriched in those natural tobacco components which have a molecular weight larger than the cut-off molecular weight of the membrane used and depleted in those natural tobacco components which have a molecular weight smaller than the cut-off molecular weight of the membrane used, compared with the membrane permeate fraction 17. On the other hand, the membrane permeate fraction 17 is enriched in those natural tobacco components which have a molecular weight smaller than the cut-off molecular weight of the membrane used and depleted in those natural tobacco components which have a molecular weight larger than the cut-off molecular weight of the membrane used, compared with the membrane non-permeate fraction 16. Whether the fraction 16 or 17 is enriched or depleted in the natural tobacco components is determined on the basis of the relative concentration/amount of the natural tobacco components.

The membrane non-permeate fraction 16 and/or the membrane permeate fraction 17 may be subjected to an additional treatment (not shown). The additional treatment includes, for example, at least one additional membrane separating treatment similar to that described above, the component separation by the chromatography, the concentrating treatment, and the component removal by using an adsorbent.

The membrane non-permeate fraction and/or the membrane permeate fraction (including the fraction subjected to an additional treatment) can be discarded, if these fractions are undesirable, and can be used as they are, or mixed (S5) with the other fraction to adjust the tobacco taste or flavor, if these fractions are desirable. Thus, in mixing the membrane non-permeate fraction with the membrane permeate fraction, the amount of at least one of these fractions is decreased.

A regenerated tobacco material 18 can be obtained by adding the tobacco flavoring agent thus prepared to the regenerated tobacco web (S6). The regenerated tobacco material 18 thus obtained produces a taste or flavor differing from that of the natural tobacco material in spite of the fact that the regenerated tobacco material 18 contains components derived from the natural tobacco material. Incidentally, where the membrane separating treatment is carried out a plurality of times by using ultrafiltration membranes or reverse osmosis filtration membranes differing from each other in the cut-off molecular weight, it is possible to add a single or a plurality of the resultant membrane non-permeate fractions and the membrane permeate fractions to the regenerated tobacco web. However, where all the membrane non-permeate fractions or the membrane permeate fractions are added to the regenerated tobacco web, the amount of at least one of the membrane non-permeate fraction and the membrane permeate fraction is decreased in adding these fractions to the regenerated tobacco web.

A first example covers the case where the amount of the nitrate contained in the natural tobacco material is decreased. In this case, a water-extracted solution obtained by extracting the natural tobacco material with water is subjected to a membrane extracting treatment using a reverse osmosis filtration membrane having a cut-off molecular weight of about 400. As a result, there is obtained a membrane non-permeate fraction enriched in those tobacco components which have a molecular weight exceeding 400 (in other words, depleted in those components which have a molecular weight not larger than 400 including inorganic ions such as nitrate ions and potassium ions). Also, there is obtained a membrane permeate fraction depleted in those tobacco components which have a molecular weight exceeding 400 (in other words, enriched in those components which have a molecular weight not larger than 400 including inorganic ions such as nitrate ions and potassium ions). It is possible to add singly the membrane non-permeate fraction depleted in the nitrate ions to the regenerated tobacco material prepared by using the extraction residue or to mix the membrane non-permeate fraction with a small amount of the membrane permeate fraction for addition to the regenerated tobacco material prepared by using the extraction residue. The cigarette manufactured by using the particular regenerated tobacco material permits markedly decreasing the amount of NOx contained in the mainstream smoke and also permits lowering the burn rate, compared with the cigarette manufactured by using the natural tobacco material.

A second example is directed to a membrane separation of the liquid extract of natural tobacco material extracted with water. In this case, used is a reverse osmosis filtration membrane having a cut-off molecular weight of about 100. As a result, there are obtained a membrane non-permeate fraction enriched in components having a molecular weight exceeding 100 including nicotine and a membrane permeate fraction enriched in components having a molecular weight not larger than 100. The cigarette manufactured by using the regenerated tobacco material prepared by adding the membrane non-permeate fraction to the regenerated tobacco web retains tobacco-likeness or the tobacco-likeness is relatively increased. In addition, since the amount of nitrate ions is decreased, the amount of NOx contained in the mainstream smoke is also decreased. Incidentally, since it is possible for the membrane non-permeate fraction, which is enriched in nicotine, to contain nitrosamines such as TSNAs, it is desirable to subject the membrane non-permeate fraction to an additional treatment so as to remove nitrosamines before the membrane non-permeate fraction is added to the regenerated tobacco web. The additional treatment noted above includes the separation by the chromatography and the removal of the nitrosamine by the sorption treatment using a nitrosamine sorption agent. The removal of the nitrosamine can also be applied to the membrane permeate fraction in the first example described above.

A third example is directed to the fractionation of the extracted solution by using two kinds of membranes. To be more specific, the extracted solution obtained by extracting the natural tobacco components with water is subjected to the membrane separating treatment using a reverse osmosis filtration membrane having a cut-off molecular weight of 100 so as to obtain a membrane non-permeate fraction (fraction A) having the amount of nitrate ions decreased as in the second example described above and a membrane permeate fraction enriched in the nitrate ions. Then, the fraction A is subjected to the membrane separating treatment using an ultrafiltration membrane having a cut-off molecular weight of about 5,000 so as to obtain a membrane non-permeate fraction (fraction B) and a membrane permeate fraction (fraction C). The fraction B is enriched in proteins, and the fraction C is enriched in sugars such as sucrose. Such being the situation, the fraction C is added, as required, to a small amount of the fraction A and/or the fraction B, and the resultant fraction mixture is added to the regenerated tobacco web so as to prepare the regenerated tobacco material. If a cigarette is manufactured by using the regenerated tobacco material thus prepared, it is possible to obtain a cigarette having the sweetness emphasized relatively.

Figure 2:
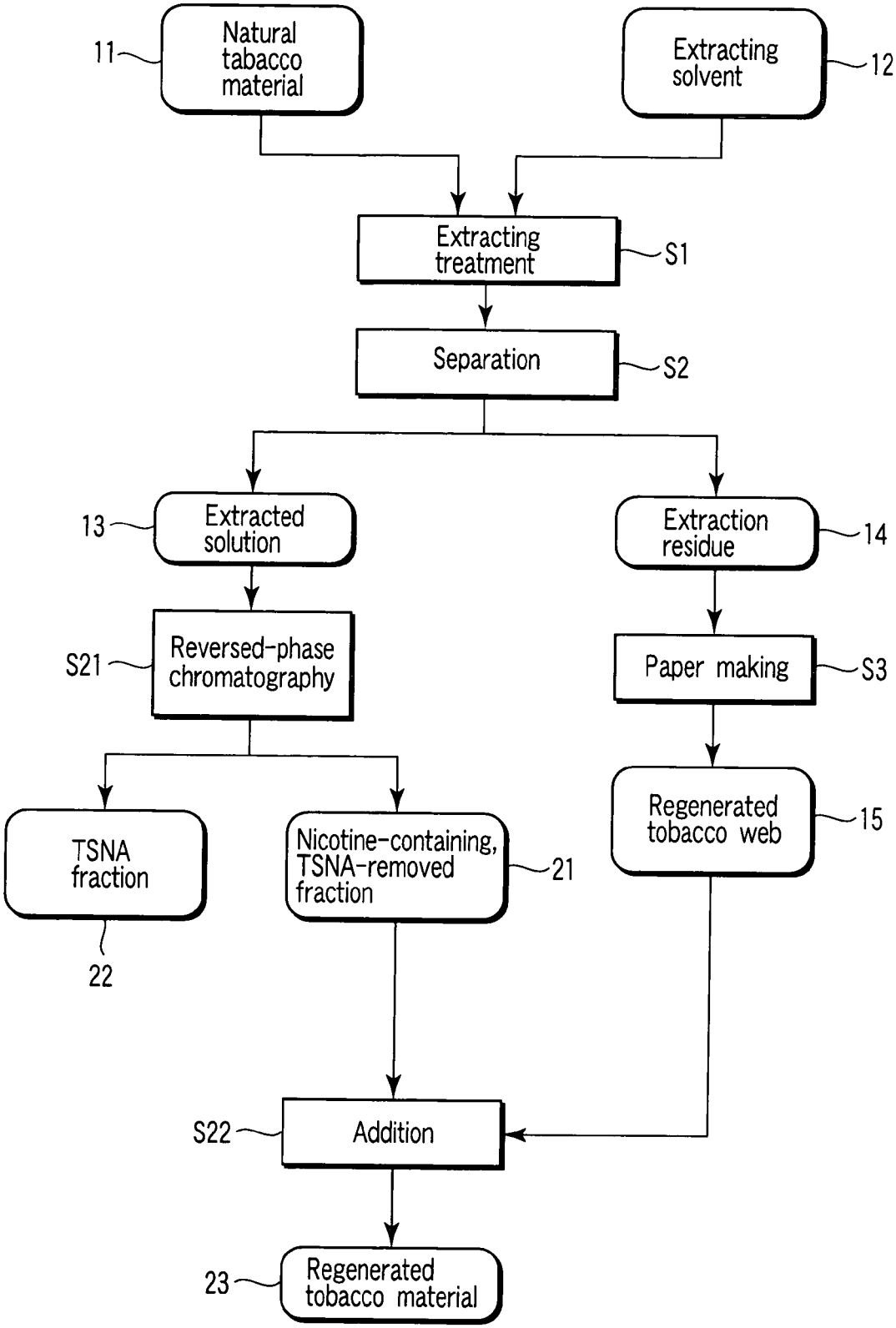
FIG. 2 is a flowchart for explaining a method of manufacturing a regenerated tobacco material according to another embodiment of the present invention.

FIG. 2 is a flowchart for explaining a method of manufacturing a regenerated tobacco material according to another embodiment of the present invention. The reference numerals used commonly in FIGS. 1 and 2 denote the same factor and the treatment required for the manufacture of the regenerated tobacco material.

In the embodiment shown in FIG. 2, the fractionating treatment of the extracted solution is carried out by reversed-phase partition chromatography. Nicotine and TSNAs can be effectively separated by the fractionating treatment of the extracted solution carried out by the reversed-phase partition chromatography.

The present inventors have paid attention to chromatography as a simple procedure for separating nicotine from TSNAs in the extracted solution obtained by extracting the natural tobacco material with an aqueous extracting solvent. The chromatography includes a size chromatography in which an eluting solution is allowed to flow into a column loaded with a loading material having pores of a prescribed size so as to separate desired components by utilizing the difference in the eluting rate that is determined by the size and shape of the molecules. However, since nicotine and TSNAs are close to each other in properties, it was difficult to separate these components by the size chromatography. Also, in ion exchange chromatography and normal phase partition chromatography, the salt concentration of the eluting solution requires pH control for separating nicotine and TSNAs adsorbed on the loading material from each other. In the case of simply using an aqueous eluting solution, it was impossible to separate nicotine and TSNA from each other.

Then, the present inventors have conducted a further research to find that the reversed-phase partition chromatography makes it possible to separate effectively nicotine and TSNA from each other even in the case of using an aqueous eluting solution.

In the embodiment shown in FIG. 2, the extracted solution 13 and the extraction residue 14 are obtained by the extracting treatment S1 using the extracting solvent 12 as described previously in conjunction with FIG. 1. The regenerated tobacco web 15 can be prepared by the paper-making process S3 using the extraction residue 14 as described previously in conjunction with FIG. 1.

The extracted solution 13 obtained by the separating treatment S2 is subjected to a separating treatment S21 that is carried out by the reversed-phase partition chromatography. The separating treatment S21 can be carried out by using a stationary phase using a (meth)acrylic series rein, a vinyl series resin or a silica series resin as a base material. It is desirable for the base material to have a hydrophobic group. The hydrophobic group is desirably a hydrocarbon group having at most six carbon atoms. A hydrocarbon group having six or less carbon atoms is certainly hydrophobic. However, probably because the degree of the hydrophobic properties of the hydrocarbon group is low (or the degree of the hydrophilic properties is relatively high), in the case of using a stationary phase formed of the base material having such a hydrophobic group, nitrosamines can be more efficiently separated from nicotine. The hydrocarbon groups having at most six carbon atoms include a methyl group, an ethyl group, a propyl group, a butyl group, a pentyl group, a hexyl group, and a phenyl group. The hydrophobic group may be the one that is introduced to modify the base material or the one that is originally included in the base material such as the methyl group of the methacrylic acid portion constituting a polymethacrylic acid-based resin. The stationary phase material having such a hydrophobic group, which is used in the reversed-phase partition chromatography, is commercially available in the form of a granular material.

For carrying out the reversed-phase partition chromatography, the tobacco extracted solution is poured into a column loaded with the stationary phase described above, followed by fractionating the tobacco extracted solution by using an aqueous eluent. The aqueous eluent can be provided by water or a mixture of water and an organic solvent miscible with water (e.g., ethanol). The reversed-phase partition chromatography can be carried out at a temperature lower than the boiling point of the solvent (e.g., 10 to 90° C.). A fraction 21 (nicotine-containing, TSNA-removed fraction) containing a significant amount of nicotine (e.g., at least 30% of the initial nicotine content), and having TSNAs substantially removed therefrom is recovered from the fractions flowing out of the column by the reversed-phase partition chromatography, and the a fraction 22 (TSNA fraction) containing a significant amount of TSNAs is discarded. According to the reversed-phase partition chromatography employed in the present invention, it is possible to obtain a fraction having a lowered ratio of nitrosamines to nicotine, compared with the natural tobacco material. Particularly, according to the present invention, it is possible to obtain a fraction having a TSNA reduction rate of at least about 90% and having a nicotine reduction rate lower than 60%, compared with the extracted solution before the fractionation. In the case of using a stationary phase material having a hydrophobic group consisting of a hydrocarbon group having at most six carbon atoms, it is possible to obtain a fraction having a TSNA reduction rate not lower than about 90% and having a nicotine reduction rate lower than 35%. A regenerated tobacco material 23 can be obtained, when the nicotine-containing TSNA-removed fraction 21, which is concentrated or not concentrated, is added (S22) partly or entirely to the regenerated tobacco web 15. The regenerated tobacco material 23 thus obtained contains nicotine, but is substantially free from TSNAs.

The present invention is described above with reference to various embodiments, but the present invention is not limited thereto. Needless to say, the embodiments described above can be employed in combination.

For example, it is possible to subject the membrane permeate fraction or the membrane non-permeate fraction obtained in the first embodiment to the fractionating treatment by the reversed-phase partition chromatography employed in the second embodiment. Particularly, the membrane permeate fraction obtained in the first embodiment and enriched in both nicotine and TSNAs can be separated into the TSNA fraction and the nicotine-enriched, TSNA-removed fraction by subjecting the membrane permeate fraction noted above to the reversed-phase partition chromatography according to the second embodiment.

The present invention will now be described by way of Examples, but the present invention is not limited thereto.

Incidentally, in the following Examples and Comparative Examples:

The NOx amount, the aromatic amine amount, and the TSNA amount contained in the mainstream smoke were measured by the Canada Method No. T-110, T-102 and T-111;

The nicotine amount in the mainstream smoke was measured by ISO 10315;

The nicotine amount in the shredded tobacco was measured by the German Industrial Standards Institute DIN 10373;

The $NO_3$ amount in the shredded tobacco was measured by extracting the shredded tobacco with water, reducing $NO_3$ in the extracted solution into nitrous acid by the hydrazine reducing method, and determining the $NO_3$ amount by chrometric determination by diazotization (see "Sanitary Test Methods" page 707 and page 836, compiled by Nippon Pharmaceutical Academic Institute); and The protein amount in the shredded tobacco was measured by the Balasubramaniam et al. method (see Balasubramaniam D et al. "Tobacco Protein Separation by two-phase extraction", Journal of Chromatography A, 989, 119-129, 2003).

Further, for analyzing the sugars, Agilent 1100 LC Chromatograph was used as the liquid chromatograph. Waters High Performance Carbohydrate Column 60A 4 μm (4.6×250 mm) was used as the column. The column temperature was set at 35° C. The sample injection amount was set at 8.0 μL. Further, acetonitrile-refined water (3:1) was used as the moving phase.

EXAMPLE 1

Extraction of shredded tobacco was conducted by mixing 200 g of shredded tobacco with 875 mL of water and stirring the mixture at 25° C. The extracted mixture thus obtained was filtered to obtain the extracted solution and the extraction residue. A regenerated tobacco web was obtained by subjecting the extraction residue to the paper-making process. Incidentally, the weight of the regenerated tobacco leaves was 100 g under the dried state, which was about half the weight of the original shredded tobacco.

On the other hand, the extracted solution was mixed with 211 mL of water and subjected to membrane separating treatment by using a reverse osmosis membrane (Nanomax 95 available from Milipore Inc.) having a cut-off molecular weight of 100 to obtain a membrane non-permeate fraction (246 mL) and a membrane permeate fraction (840 mL). The amounts of nitric acid and sugar (fructose and glucose) contained in the membrane non-permeate fraction and membrane permeate fraction thus obtained were analyzed to obtain the results given in Table 1 below. Table 1 also shows the analytical results of the extracted solution.

TABLE 1

| Fraction | Fraction amount (mL) | Component amount in each fraction: Nitric acid (mg) | Fructose (g) | Glucose (g) |
|---|---|---|---|---|
| Membrane non-permeate fraction | 246 | 201 | 1.46 | 0.72 |
| Membrane permeate fraction | 840 | 193 | 0 | 0 |
| Extracted solution before fractionation | 875 | 394 | 1.46 | 0.72 |

As is apparent from the results given in Table 1, the membrane non-permeate fraction was enriched in sugar and depleted in nitric acid. On the other hand, the membrane permeate fraction was depleted in sugar (0 in this case), and enriched in nitric acid.

Then, the entire amount (246 mL) of the membrane non-permeate fraction was added to 100 g of the regenerated tobacco web to obtain a regenerated tobacco material, and cigarettes were manufactured by using the resultant regenerated tobacco material.

On the other hand, an additional extracting treatment was performed in exactly the same procedures as those of the extracting treatment described above, and a regenerated tobacco web was prepared from the extraction residue in the similar manner. The extracted solution was not subjected to the membrane separating treatment and was only concentrated by heating under vacuum. The entire amount of the concentrated extracted solution was added to the regenerated tobacco web to obtain a regenerated tobacco material, and cigarettes were manufactured by using the resultant regenerated tobacco material.

These cigarettes were smoked in the bell-type smoke inhaling profile in accordance with the ISO method, with the one puff time set at 2 seconds (the smoke inhaling amount in one puff of 35 mL) so as to measure the NOx amount in the mainstream smoke, and the NOx amount per mg of tar was calculated. Table 2 shows the results.

TABLE 2

| Cigarette | NOx amount in mainstream smoke: NOx amount per cigarette (μg) | NOx amount per mg of tar (μg) |
|---|---|---|
| Extracted solution added | 230 | 10.9 |
| Membrane non-permeate fraction added | 117 | 5.3 |

As is apparent from the results given in Table 2, it is possible to decrease the NOx amount in the mainstream smoke of the cigarette and to decrease the NOx amount per unit amount (mg) of tar by adding the membrane non-permeate fraction that is depleted in nitric acid to the regenerated tobacco web.

EXAMPLE 2

An extracting treatment similar to that in Example 1 was applied to shredded tobacco differing from that used in Example 1 to obtain an extracted solution and an extraction residue. A regenerated tobacco web was obtained by subjecting the extraction residue to the paper-making process.

On the other hand, the extracted solution was subjected to a membrane separating treatment by using a reverse osmosis membrane (NTR-729HG available from Nitto Denko K.K.) The membrane non-permeate fraction thus obtained was added to the regenerated tobacco web to obtain a regenerated tobacco material, which was shredded so as to obtain shredded tobacco.

Also, an extracting treatment was carried out exactly as above, and a regenerated tobacco web was obtained by subjecting the resultant extraction residue to the paper-making process. Also, the extracted solution obtained by the extracting treatment was concentrated by heating under vacuum, and the entire amount of the concentrated extracted solution was added to the regenerated tobacco web to obtain a regenerated tobacco material, which was shredded to obtain shredded tobacco.

The $NO_3$ amount and the nicotine amount in the shredded tobacco thus obtained were measured. The results are shown in Table 3.

TABLE 3

| Shredded tobacco | $NO_3$ amount in shredded tobacco (mg/g) | Nicotine amount in shredded tobacco (mg/g) |
|---|---|---|
| Extracted solution added | 6.17 | 7.5 |
| Membrane non-permeate fraction added | 0.3 | 6.6 |

As is apparent from the results given in Table 3, the $NO_3$ amount in the shredded tobacco was lowered by about 95% in the shredded tobacco manufactured from the regenerated tobacco material obtained by adding the membrane non-permeate fraction to the regenerated tobacco web, compared with the shredded tobacco manufactured from the regenerated tobacco material to which was added the extracted solution not subjected to the membrane separating treatment in spite of the fact that the reduction in the nicotine amount was suppressed in the shredded tobacco involving the membrane non-permeate fraction.

Cigarettes were manufactured by using each of the shredded tobacco described above so as to measure the NOx amount and the nicotine amount in the mainstream smoke as in Example 1. Table 4 shows the results.

TABLE 4

| Cigarette | NOx amount in mainstream smoke: Per cigarette (μg) | Per mg of tar (μg) | Nicotine amount in mainstream smoke: Per cigarette (mg) | Per mg of tar (mg) |
|---|---|---|---|---|
| Shredded tobacco added with extracted solution | 154 | 9.7 | 0.6 | 0.045 |

TABLE 4-continued

| Cigarette | NOx amount in mainstream smoke | | Nicotine amount in mainstream smoke | |
|---|---|---|---|---|
| | Per cigarette (μg) | Per mg of tar (μg) | Per cigarette (mg) | Per mg of tar (mg) |
| Shredded tobacco added with membrane non-permeate fraction | 27 | 1.8 | 0.6 | 0.040 |

As is apparent from the results given in Table 4, the cigarette manufactured by using the shredded tobacco having the membrane non-permeate fraction added thereto was found to be fully comparable in the nicotine amount and to permit markedly decreasing the NOx amount, compared with the cigarette manufactured by using the shredded tobacco to which was added the extracted solution not subjected to the membrane separating treatment.

EXAMPLE 3

An extracting treatment similar to that in Example 1 was applied to shredded tobacco differing from that used in Example 1 to obtain an extracted solution and an extraction residue. A regenerated tobacco web was obtained by subjecting the extraction residue to the paper-making process.

On the other hand, the extracted solution was subjected to the membrane separating treatment by using an ultrafiltration membrane (CF30-F-PT available from Nitto Denko K.K.; cut-off molecular weight of 50,000) and the membrane non-permeate fraction thus obtained was further subjected to the membrane separating treatment by using a reverse osmosis membrane (NTR-729HG available from Nitto Denko K.K). The membrane non-permeate fraction obtained was added to the regenerated tobacco web to obtain a regenerated tobacco material, which was shredded to obtain shredded tobacco.

Also, an extracting treatment was carried out exactly as above, and a regenerated tobacco web was obtained by subjecting the resultant extraction residue to the paper-making process. Also, the extracted solution obtained was concentrated by heating under vacuum, and the entire amount of the concentrated extracted solution was added to the regenerated tobacco web to obtain a regenerated tobacco material, which was shredded so as to obtain shredded tobacco.

The $NO_3$ amount, the nicotine amount and the protein amount in the shredded tobacco thus obtained were measured. The results are shown in Table 5.

TABLE 5

| Shredded tobacco | $NO_3$ amount in shredded tobacco (mg/g) | Nicotine amount in shredded tobacco (mg/g) | Protein amount in shredded tobacco (mg/g) |
|---|---|---|---|
| Shredded tobacco added with extracted solution | 6.17 | 7.5 | 16 |

TABLE 5-continued

| Shredded tobacco | $NO_3$ amount in shredded tobacco (mg/g) | Nicotine amount in shredded tobacco (mg/g) | Protein amount in shredded tobacco (mg/g) |
|---|---|---|---|
| Shredded tobacco added with membrane non-permeate fraction | 0.22 | 7.5 | 0 |

As is apparent from the results given in Table 5, the shredded tobacco prepared from the regenerated tobacco material obtained by adding to the regenerated tobacco web the membrane non-permeate fraction obtained by subjecting the membrane permeate fraction in the ultrafiltration to the reverse osmosis filtration was found to decrease the $NO_3$ amount in the shredded tobacco by about 95% and also found to remove protein substantially completely in spite of the fact that the decrease of the nicotine amount was suppressed, compared with the shredded tobacco of the regenerated tobacco material involving the extracted solution that was not subjected to the membrane treatment.

Cigarettes were manufactured by using each of the shredded tobacco described above so as to measure the NOx amount and the nicotine amount in the mainstream smoke as in Example 1. Table 6 shows the results.

TABLE 6

| Cigarette | NOx amount in mainstream smoke | | Nicotine amount in mainstream smoke | |
|---|---|---|---|---|
| | Per cigarette (μg) | Per mg of tar (μg) | Per cigarette (mg) | Per mg of tar (mg) |
| Shredded tobacco added with extracted solution | 154 | 9.7 | 0.6 | 0.045 |
| Shredded tobacco added with membrane non-permeate fraction | 25 | 1.9 | 0.6 | 0.040 |

As is apparent from the results given in Table 6, the cigarette of the present invention manufactured by using the regenerated tobacco material obtained by adding to the regenerated tobacco web the membrane non-permeate fraction obtained by subjecting the membrane permeate fraction obtained in the ultrafiltration treatment to the reverse osmosis filtration was found to be fully comparable in the nicotine amount and to permit markedly decreasing the NOx amount, compared with the cigarette manufactured by using the shredded tobacco to which was added the extracted solution not subjected to the membrane separating treatment.

These cigarettes were evaluated by 10 panelists, with the result that there was obtained a common evaluation that the rare odor was decreased in the cigarette of the present invention.

EXAMPLE 4

An extracting treatment similar to that in Example 1 was applied to shredded tobacco differing from that used in Example 1 to obtain an extracted solution and an extraction residue. A regenerated tobacco web was obtained by subjecting the extraction residue to the paper-making process.

On the other hand, the extracted solution was subjected to the membrane separating treatment by using an ultrafiltration membrane (Biomax 10 available from Milipore Inc.; cut-off molecular weight of 50,000), and the membrane non-permeate fraction thus obtained was further subjected to the membrane separating treatment by using a reverse osmosis membrane (Nanomax 95 of about 100). The membrane non-permeate fraction obtained was added to the regenerated tobacco web to obtain a regenerated tobacco material, which was shredded to obtain shredded tobacco. Further, a cigarette was manufactured by using the shredded tobacco.

Also, an extracting treatment was carried out exactly as above, and a regenerated tobacco web was obtained by subjecting the resultant extraction residue to the paper-making process. Also, the extracted solution obtained by the extracting treatment was concentrated by the heating under vacuum, and the entire amount of the concentrated extracted solution was added to the regenerated tobacco web to obtain a regenerated tobacco material, which was shredded so as to obtain shredded tobacco. Further, a cigarette was manufactured by using the shredded tobacco.

The amounts of aromatic amines contained in the mainstream smoke of the cigarette thus obtained were measured. Table 7 shows the results.

As is apparent from the results given in Table 7, the cigarette of the present invention manufactured by using the regenerated tobacco material obtained by adding to the regenerated tobacco web the membrane non-permeate fraction obtained by subjecting the membrane permeate fraction in the ultrafiltration treatment to the reverse osmosis filtration was found to permit markedly decreasing the aromatic amines in the mainstream smoke, compared with the cigarette manufactured by using the shredded tobacco to which was added the extracted solution not subjected to the membrane separating treatment.

EXAMPLE 5

100 g of shredded tobacco, which was a mixture of shredded tobacco (mixture of flue-cured species and burley species) and shredded central vain mixed at a weight ratio of 1:1 was mixed with 1,000 mL of water and stirred at 25° C. to effect extraction of the shredded tobacco. The extracted mixture obtained was filtered to obtain an extracted solution and an extraction residue. The extraction residue was subjected to the paper-making process to obtain a regenerated tobacco web.

On the other hand, the extracted solution was concentrated by the membrane separating treatment, and 1 mL of the concentrated solution was poured into a column (a diameter of 8 mm and a length of 300 mm) loaded with a polymethacrylic resin particles having a particle diameter of 200 to 600 μm (trade name: HP2MG available from Mitsubishi Chemical Co., Ltd.). Water was poured into the column as an eluent to obtain firstly 70 mL (fraction 1) and then 8030 mL (fraction 2). The amounts of nicotine, nitrosamines (N'-nitrosonornicotine (NNN), 4-(methylnitrosamino)-1-(3-pyridyl)-1-butanone (NNK) and N'-nitrosoanatabine (NAT)) were analyzed for the extracted solution before the fractionation (untreated extracted solution) and for each fraction. Table 8 shows the results. The nicotine reduction rate and the TSNA reduction rate are also shown in Table 8.

TABLE 7

| | Amount of aromatic amines in mainstream smoke | | | | | | | |
|---|---|---|---|---|---|---|---|---|
| | Per cigarette | | | | Per mg of tar | | | |
| | 1-amino-naphthalene (ng) | 2-amino-naphthalene (ng) | 3-amino-biphenyl (ng) | 4-amino-biphenyl (ng) | 1-amino-naphthalene (ng) | 2-amino-naphthalene (ng) | 3-amino-biphenyl (ng) | 4-amino-biphenyl (ng) |
| Shredded tobacco added with extracted solution | 10.235 | 7.8325 | 5.405 | 2.2 | 0.56339 | 0.43115 | 0.29752 | 0.1211 |
| Shredded tobacco added with membrane non-permeate fraction | 7.3525 | 5.4275 | 2.965 | 1.21 | 0.3191 | 0.23555 | 0.12868 | 0.05251 |

TABLE 8

| | Liquid amount (mL) | Nicotine (mg) | Nicotine reduction rate | NNN (μg) | NNK (μg) | NAT (μg) | TSNA total amount (μg) | TSNA reduction rate |
|---|---|---|---|---|---|---|---|---|
| Untreated extracted solution | 1 | 2.81 | — | 0.94 | 0.04 | 0.04 | 1.02 | — |
| Fraction 1 | 70 | 2.73 | 3% | 0.11 | 0.00 | 0.00 | 0.11 | 89% |
| Fraction 2 | 8030 | 0.08 | 97% | 0.83 | 0.04 | 0.04 | 0.91 | 11% |

As is apparent from Table 8, TSNAs were decreased from the initial amount by substantially 89% in fraction 1. NNK and NAT among TSNAs were completely removed in fraction 1. In addition, nicotine was decreased from the initial amount by only 3% in fraction 1.

Accordingly, fraction 2 was discarded, and a regenerated tobacco material was prepared by adding fraction 1 to the regenerated tobacco web.

EXAMPLE 6

Ale;2q concentrated tobacco extracted solution and a regenerated tobacco web were prepared as in Example 5, except that the mixing ratio of the flue-cured species to the burley species was changed. 1 mL of the concentrated tobacco extracted solution was poured into a column (a diameter of 10 mm and a length of 250 mm) loaded with a phenyl group-modified polyvinyl resin having a particle diameter of 50 to 150 μm (trade name of TOYOPEARL Phenyl 650C available from Toso Inc.). Water used as an eluent was poured into the column to obtain first 28 mL (fraction 1), and then 115 mL (fraction 2). The amounts of nicotine, NNN, NNK, NAT, and also N'-nitrosoanabasine (NAB) were analyzed for the extracted solution before the fractionation (untreated extracted solution) and each fraction. Table 9 shows the results. The nicotine reduction rate and the TSNA reduction rate are also shown in Table 9.

TABLE 9

| | Liquid amount (mL) | Nicotine (mg) | Nicotine reduction rate | NNN (μg) | NNK (μg) | NAT (μg) | NAB (μg) | TSNA total amount (μg) | TSNA reduction rate |
|---|---|---|---|---|---|---|---|---|---|
| Untreated extracted solution | 1 | 2.51 | — | 0.80 | 0.20 | 0.21 | 0.21 | 1.42 | — |
| Fraction 1 | 28 | 2.51 | 0% | 0.13 | 0.00 | 0.00 | 0.00 | 0.13 | 91% |
| Fraction 2 | 115 | 0.00 | 100% | 0.68 | 0.20 | 0.21 | 0.21 | 1.30 | 9% |

As shown in Table 9, TSNAs were decreased from the initial amount by substantially 91% in fraction 1. Also, NNK, NAT and NAB among TSNAs were removed completely in fraction 1. In addition, nicotine was not decreased at all in fraction 1.

Accordingly, fraction 2 was discarded, and a regenerated tobacco material was prepared by adding fraction 1 to the regenerated tobacco web.

EXAMPLE 7

A concentrated tobacco extracted solution and a regenerated tobacco web were prepared as in Example 1, except that the mixing ratio of the flue-cured species to the burley species was changed. 0.02 mL of the concentrated tobacco extracted solution was poured into a column (a diameter of 6 mm and a length of 150 mm) loaded with a butyl group-modified silica based resin having an average particle diameter of 15 μm (trade name of Pack C4 available from YMC Inc. Water used as an eluent was poured into the column to obtain first 600 mL (fraction 1), and then 400 mL (fraction 2). The amounts of nicotine, NNN, NNK, NAT, and NAB were analyzed for the extracted solution before the fractionation (untreated extracted solution) and each fraction. Table 10 shows the results. The nicotine reduction rate and the TSNA reduction rate are also shown in Table 10.

TABLE 10

| | Liquid amount (mL) | Nicotine (mg) | Nicotine reduction rate | NNN (μg) | NNK (μg) | NAT (μg) | NAB (μg) | TSNA total amount (μg) | TSNA reduction rate |
|---|---|---|---|---|---|---|---|---|---|
| Untreated extracted solution | 0.02 | 2.16 | — | 2.29 | 0.56 | 1.47 | 1.47 | 5.79 | — |
| Fraction 1 | 600 | 0.72 | 67% | 2.29 | 0.56 | 1.47 | 1.47 | 5.79 | 0% |
| Fraction 2 | 400 | 1.44 | 33% | 0.00 | 0.00 | 0.00 | 0.00 | 0.00 | 100% |

As shown in Table 10, TSNAs were decreased by 100% in fraction 2. In addition, the nicotine reduction amount from the initial amount was found to be only 33% in fraction 2.

Accordingly, fraction 1 was discarded, and a regenerated tobacco material was prepared by adding fraction 2 to the regenerated tobacco web.

As apparent from the results for Examples 5 to 7, the TSNA reduction rate was not lower than 90%, and a fraction can be obtained in which the nicotine reduction rate is lower than 35%, in the case of using a stationary phase material having hydrophobic groups formed of hydrocarbon groups having at most 6 carbon atoms.

EXAMPLE 8

A concentrated tobacco extracted solution and a regenerated tobacco web were prepared as in Example 5, except that the mixing ratio of the flue-cured species to the burley species was changed. 0.02 mL of the concentrated tobacco extracted solution was poured into a column (a diameter of 4.6 mm and a length of 150 mm) loaded with an octyl group-modified silica-based resin having an average particle diameter of 5 μm (trade name of XDB-C8 available from Alingent Inc). Water used as an eluent was poured into the column to obtain first 200 mL (fraction 1), then 200 mL (fraction 2), and finally 400 mL (fraction 3). The amounts of nicotine, NNN, NNK, NAT, and NAB were analyzed for the extracted solution before the fractionation (untreated extracted solution) and each fraction. Table 11 shows the results. The nicotine reduction rate and the TSNA reduction rate are also shown in Table 11.

TABLE 11

| | Liquid amount (mL) | Nicotine (mg) | Nicotine reduction rate | NNN (μg) | NNK (μg) | NAT (μg) | NAB (μg) | TSNA total amount (μg) | TSNA reduction rate |
|---|---|---|---|---|---|---|---|---|---|
| Untreated extracted solution | 0.02 | 1.64 | — | 2.22 | 0.77 | 2.49 | 0.04 | 5.52 | — |
| Fraction 1 | 200 | 0.00 | 100% | 1.83 | 0.00 | 0.00 | 0.00 | 1.83 | 67% |
| Fraction 2 | 200 | 0.92 | 44% | 0.39 | 0.77 | 2.49 | 0.04 | 3.69 | 33% |
| Fraction 3 | 400 | 0.72 | 56% | 0.00 | 0.00 | 0.00 | 0.00 | 0.00 | 100% |

As shown in Table 11, TSNAs were removed completely in fraction 3. In addition, the nicotine reduction rate was 56% in fraction 3.

Accordingly, fractions 1 and 2 were discarded, and a regenerated tobacco material was prepared by adding fraction 3 to the regenerated tobacco web.

EXAMPLE 9

A concentrated tobacco extracted solution and a regenerated tobacco web were prepared as in Example 1, except that the mixing ratio of the flue-cured species to the burley species was changed. 0.02 mL of the concentrated tobacco extracted solution was poured into a column (a diameter of 6 mm and a length of 150 mm) loaded with a octadecyl group-modified silica-based resin having an average particle diameter of 15 μm (trade name of ODS-AP available from YMC Inc). Water used as an eluent was poured into the column to obtain first 400 mL (fraction 1), then 200 mL (fraction 2), and finally 200 mL (fraction 3). The amounts of nicotine, NNN, NNK, NAT, and NAB were analyzed for the extracted solution before the fractionation (untreated extracted solution) and each fraction. Table 12 shows the results. The nicotine reduction rate and the TSNA reduction rate are also shown in Table 12.

TABLE 12

| | Liquid amount (mL) | Nicotine (mg) | Nicotine reduction rate | NNN (μg) | NNK (μg) | NAT (μg) | NAB (μg) | TSNA total amount (μg) | TSNA reduction rate |
|---|---|---|---|---|---|---|---|---|---|
| Untreated extracted solution | 0.02 | 2.17 | — | 2.33 | 0.57 | 2.28 | 0.03 | 5.21 | — |
| Fraction 1 | 400 | 0.37 | 83% | 2.33 | 0.00 | 0.00 | 0.00 | 2.33 | 55% |
| Fraction 2 | 200 | 1.03 | 53% | 0.00 | 0.57 | 2.28 | 0.03 | 2.88 | 45% |
| Fraction 3 | 200 | 0.76 | 65% | 0.00 | 0.00 | 0.00 | 0.00 | 0.00 | 100% |

As shown in Table 12, TSNAs were removed completely in fraction 3. In addition, the nicotine reduction rate for fraction 3 was found to be 65%.

Accordingly, fractions 1 and 2 were discarded, and a regenerated tobacco material was prepared by adding fraction 3 to the regenerated tobacco web.

COMPARATIVE EXAMPLE 1

1 mL of a concentrated tobacco extracted solution prepared as in Example 5 except that the mixing ratio of the flue-cured species to the burley species was changed was poured into a column (a diameter of 10 mm and a length of 250 mm) loaded with a polystyrene-based cation exchange resin having an average particle diameter of 300 μm (counter ion: $Na^+$; trade name of CR-1310 available from Organo Inc.). Water used as an eluent was poured into the column to obtain first 100 mL (fraction 1) and, then, 900 mL (fraction 2). The amounts of nicotine, NNN, NNK, NAT and NAB were analyzed for the extracted solution before the fractionation (untreated extracted solution) and each fraction. Table 13 shows the results. The nicotine reduction rate and the TSNA reduction rate are also shown in Table 13.

TABLE 13

| | Liquid amount (mL) | Nicotine (mg) | Nicotine reduction rate | NNN (μg) | NNK (μg) | NAT (μg) | NAB (μg) | TSNA total amount (μg) | TSNA reduction rate |
|---|---|---|---|---|---|---|---|---|---|
| Untreated extracted solution | 1 | 3.09 | — | 1.04 | 0.43 | 0.33 | 0.02 | 1.82 | — |
| Fraction 1 | 100 | 0.00 | 100% | 0.00 | 0.00 | 0.00 | 0.02 | 0.02 | 99% |
| Fraction 2 | 900 | 0.00 | 100% | 0.00 | 0.43 | 0.00 | 0.00 | 0.43 | 76% |

As shown in Table 13, TSNAs were significantly removed in each of fractions 1 and 2. However, nicotine was removed completely in these fractions. Clearly, it is impossible to obtain a regenerated tobacco material containing nicotine in the case of using any of fractions 1 and 2.

COMPARATIVE EXAMPLE 2

0.22 mL of a concentrated tobacco extracted solution prepared as in Example 1 except that the mixing ratio of the flue-cured species to the burley species was changed was poured into a column (a diameter of 4.6 mm and a length of 250 mm) loaded with a polystyrene-based anion exchange resin having an average particle diameter of 7 μm (counter ion: $CH_3COO^-$; trade name of CDR-10 available from Mitsubishi Chemical Co., Ltd.) Water used as an eluent was poured into the column so obtain first 500 mL (fraction 1) and, then, 950 mL (fraction 2). The amounts of nicotine, NNN, NNK, NAT and NAB were analyzed for the extracted solution before the fractionation (untreated extracted solution) and each fraction. Table 14 shows the results. The nicotine reduction rate and the TSNA reduction rate are also shown in Table 14.

TABLE 14

| | Liquid amount (mL) | Nicotine (mg) | Nicotine reduction rate | NNN (μg) | NNK (μg) | NAT (μg) | NAB (μg) | TSNA total amount (μg) | TSNA reduction rate |
|---|---|---|---|---|---|---|---|---|---|
| Untreated extracted solution | 0.22 | 0.78 | — | 0.53 | 0.22 | 1.21 | 0.07 | 2.03 | — |
| Fraction 1 | 50 | 0.78 | 0% | 0.20 | 0.00 | 0.29 | 0.04 | 0.53 | 74% |
| Fraction 2 | 950 | 0.00 | 100% | 0.33 | 0.22 | 0.92 | 0.03 | 1.50 | 26% |

As shown in Table 14, TSNAs were significantly removed in fraction 1. However, nicotine was also removed completely. On the other hand, the initial nicotine amount was maintained by 100% in fraction 2. However, the TSNA reduction rate was only 26%. Clearly, it is impossible to obtain a regenerated tobacco material containing a significant amount of nicotine and substantially free from TSNA in the case of using any of fractions 1 and 2.

COMPARATIVE EXAMPLE 3

0.5 mL of a concentrated tobacco extracted solution prepared as in Example 5 except that the mixing ratio of the flue-cured species to the burley species was changed was poured into a column (a diameter of 7.5 mm and a length of 50 mm) loaded with a silica-based resin for normal phase partition chromatography having a particle diameter of 40-60 μm (trade name of Daisogel 2000 available from Daiso Inc). Water used as an eluent was poured into the column to obtain first 10 mL (fraction 1), then, 10 mL (fraction 2), then, 10 mL (fraction 3), then, 10 mL (fraction 4), and finally 110 mL (fraction 5). The amounts of nicotine, NNN, NNK, and NAT were analyzed for the extracted solution before the fractionation (untreated extracted solution) and each fraction. Table 15 shows the results. The nicotine reduction rate and the TSNA reduction rate are also shown in Table 15.

TABLE 15

| | Liquid amount (mL) | Nicotine (mg) | Nicotine reduction rate | NNN (μg) | NNK (μg) | NAT (μg) | TSNA total amount (μg) | TSNA reduction rate |
|---|---|---|---|---|---|---|---|---|
| Untreated extracted solution | 0.5 | 1.05 | — | 0.89 | 0.02 | 0.15 | 1.06 | — |
| Fraction 1 | 10 | 0.12 | 89% | 0.25 | 0.00 | 0.02 | 0.27 | 75% |
| Fraction 2 | 10 | 0.31 | 72% | 0.39 | 0.22 | 0.05 | 0.66 | 38% |
| Fraction 3 | 10 | 0.19 | 82% | 0.17 | 0.00 | 0.06 | 0.23 | 78% |
| Fraction 4 | 10 | 0.09 | 91% | 0.08 | 0.00 | 0.02 | 0.02 | 98% |
| Fraction 5 | 110 | 0.35 | 67% | 0.00 | 0.00 | 0.00 | 0.00 | 100 |

As shown in Table 15, TSNAs were significantly removed in fractions 1 to 5. However, the nicotine reduction rate was not lower than about 70%. It follows that it is impossible to obtain a regenerated tobacco material containing a significant amount of nicotine and substantially free from TSNA by using any of fractions 1 to 5.

What is claimed is:

1. A method of manufacturing a regenerated tobacco material, comprising:

(a) extracting a natural tobacco material with an extracting solvent to obtain an extracted solution containing components of the natural tobacco material and an extraction residue, the natural tobacco materials containing both desired and undesired components, wherein the desired component is nicotine, and the undesired component is selected from nitrates and/or tobacco-specific nitrosamines (TSNAs);

(b) fractionating the extracted solution to obtain a first fraction enriched in the desired component and depleted in the undesired component and a second fraction enriched in the undesired component and depleted in the desired component;

(c) preparing a regenerated tobacco web from the extraction residue; and (d) adding the first fraction to the regenerated tobacco web optionally together with the second fraction decreased in amount, wherein the fractionating treatment is carried out by means of a reverse osmosis filtration membrane to obtain a membrane permeate fraction and a membrane non-permeate fraction; and wherein the fractionating treatment is carried out a plurality of times by means of membranes differing from each other in cut-off molecular weight, and one or more of membrane non-permeate fractions and membrane permeate fractions obtained from the fractionating treatment are added to the regenerated tobacco web, provided that, where all of the obtained membrane non-permeate fractions and the membrane permeate fractions are added to the regenerated tobacco web, the amount of at least one of the obtained membrane non-permeate fraction and the membrane permeate fraction is decreased in adding the fractions to the regenerated tobacco web.

2. The method according to claim 1, wherein the membrane non-permeate fraction is depleted in nitrate ions, and is added to the regenerated tobacco web.

3. A method of manufacturing a regenerated tobacco material, comprising:

(a) extracting a natural tobacco material with an extracting solvent to obtain an extracted solution containing components of the natural tobacco material and an extraction residue, the natural tobacco materials containing both desired and undesired components, wherein the desired component is nicotine, and the undesired component is tobacco-specific nitrosamines (TSNAs);

(b) fractionating the extracted solution to obtain a first fraction enriched in the desired component and depleted in the undesired component and a second fraction enriched in the undesired component and depleted in the desired component;

(c) preparing a regenerated tobacco web from the extraction residue; and (d) adding the first fraction to the regenerated tobacco web optionally together with the second fraction decreased in amount, wherein the fractionating treatment is carried out by reversed-phase partition chromatography to obtain a faction containing a decreased amount of TSNAs from the extracted solution.

4. The method according to claim 3, wherein the reversed-phase partition chromatography is carried out with a stationary phase including as a base material a (meth)acrylic resin, a vinyl resin, or a silica-based resin, and the base material has a hydrophobic group including a hydrocarbon group having 6 carbon atoms or less.

5. The method according to claim 3, wherein the extracted solution containing a decreased amount of nitrosamines has a ratio of nitrosamine to nicotine lower than that of the natural tobacco material.

6. A method of manufacturing a regenerated tobacco material, comprising:

(a) extracting a natural tobacco material with an extracting solvent to obtain an extracted solution containing components of the natural tobacco material and an extraction residue, the natural tobacco materials containing both desired and undesired components, wherein the desired component is nicotine, and the undesired component is nitrates and/or tobacco-specific nitrosamines (TSNAs);

(b) fractionating the extracted solution to obtain a first fraction enriched in the desired component and depleted in the undesired component and a second fraction enriched in the undesired component and depleted in the desired component;

(c) preparing a regenerated tobacco web from the extraction residue; and (d) adding the first fraction to the regenerated tobacco web optionally together with the second fraction decreased in amount, wherein the membrane permeate fraction is subjected to the fractionating treatment by the reversed-phase partition chromatography to obtain from the membrane permeate fraction a fraction enriched in nicotine and having nitrates and/or TSNAs removed therefrom.

7. The method according to claim 6, wherein the membrane non-permeate fraction is depleted in nitrate ions, and is added to the regenerated tobacco web.

8. The method according to claim 6, wherein the reversed-phase partition chromatography is carried out with a stationary phase including as a base material a (meth)acrylic resin, a vinyl resin, or a silica-based resin, and the base material has a hydrophobic group including a hydrocarbon group having 6 carbon atoms or less.

* * * * *